US006106224A

United States Patent [19]

Sheth et al.

[11] Patent Number: 6,106,224

[45] Date of Patent: Aug. 22, 2000

[54] DOWNTHRUST PADS FOR SUBMERSIBLE CENTRIFUGAL PUMPS

[75] Inventors: Ketankumar Kantilal Sheth, Tulsa; Dwight Cameron Chilcoat, Dewey, both of Okla.

[73] Assignee: Camco International Inc., Houston, Tex.

[21] Appl. No.: 09/054,124

[22] Filed: Apr. 2, 1998

[51] Int. Cl.[7] ..... F04D 29/12

[52] U.S. Cl. ..... 415/104; 415/107; 415/172.1; 415/174.3; 415/174.4; 415/173.3; 415/173.4; 415/229; 415/198.1; 415/199.1; 415/199.2; 415/199.3; 417/365; 417/423.5; 417/424.1; 417/423.12

[58] Field of Search ..... 415/104, 107, 415/172.1, 174.3, 174.4, 229, 173.3, 170.4, 198.1, 199.1, 199.2, 199.3; 417/365, 423.5, 424.1, 423.12

[56] References Cited

U.S. PATENT DOCUMENTS

| | | | |
|---|---|---|---|
| 4,483,660 | 11/1984 | Roberts | 416/213 A |
| 4,678,399 | 7/1987 | Vandevier et al. . | |
| 4,741,668 | 5/1988 | Bearden . | |
| 4,781,531 | 11/1988 | James . | |
| 4,838,758 | 6/1989 | Sheth . | |
| 4,865,519 | 9/1989 | Diankui et al. | 415/210.1 |
| 4,872,808 | 10/1989 | Wilson . | |
| 5,133,639 | 7/1992 | Gay et al. | 415/170.1 |
| 5,209,577 | 5/1993 | Swatek . | |
| 5,660,520 | 8/1997 | Scarsdale | 415/104 |
| 5,722,812 | 3/1998 | Knox et al. | 415/199.1 |

FOREIGN PATENT DOCUMENTS

| | | |
|---|---|---|
| 108869A2 | 8/1983 | European Pat. Off. . |
| 634827A2 | 7/1994 | European Pat. Off. . |
| 19705407A1 | 2/1997 | Germany . |

*Primary Examiner*—Edward K. Look
*Assistant Examiner*—Matthew T. Shanley
*Attorney, Agent, or Firm*—Fulbright & Jaworski L.L.P.

[57] ABSTRACT

A submersible centrifugal pump is claimed which includes an inner downthrust washer for receiving the downthrust load from the upward movement of the produced fluid, and an outer sealing washer, which is a non-load bearing washer, for allowing the repositioning of the impeller to prevent gaps that create recirculation.

18 Claims, 3 Drawing Sheets

DOWNTHRUST PADS FOR SUBMERSIBLE CENTRIFUGAL PUMPS

BACKGROUND OF THE INVENTION

1. Technical Field of the Invention

The present invention relates generally to a means for absorbing the thrust generated by the impellers in each stage of a multi-stage centrifugal submersible pump, and to a means for reducing abrasive wear in such pump.

2. Prior Art

One primary means for delivering oil from a subsurface reservoir is by mechanically pumping it to the surface. One type of pump frequently used in the industry is known as a multi-stage electric submersible pump. This type of pump includes a downhole motor coupled to a centrifugal pump. The pump is comprised of a number of impellers which in turn consist of a number of vanes. As the impeller turns driven by a central shaft, the impeller vanes impart velocity to the fluid (e.g. crude oil). As the fluid is carried to the outermost portion of the impeller vane, it is transferred to the adjoining diffuser, which is stationary. Essentially, the purpose of the diffuser is to transform the fluid velocity into hydraulic head, or pressure. In turn, the diffuser guides the fluid upward into the next impeller. A diffuser and impeller comprise one "stage" of the pumping system.

Pressure gradients and momentum transferred across the impeller create a hydraulic thrust in each stage. In most operating conditions, this hydraulic thrust is in a generally downward direction and will be referred to herein as "downthrust." Excessive downthrust can have deleterious effects on a pumping system. In the longitudinal direction, downthrust can cause the impellers to contact the adjacent diffuser with force sufficient to cause damage to these components and the shaft. Hence the downthrust must be absorbed by bearings or washers either externally or located within the pump assembly.

The present invention is directed to three problems relating to submersible centrifugal pumps, which are best described with reference to the prior art. First, radial stability of the shaft is a desirable attribute; if the shaft becomes unaligned even slightly it can rub against the diffuser or impeller hubs creating friction and ultimately wear on the components. The Swatek patent (U.S. Pat. No. 5,209,577) discloses a compliant bearing system designed to achieve radial stability of the shaft. In addition, downthrust created by the upward movement of the produced fluid is also problematic because it can cause compaction of the components comprising the stages onto one another, ultimately resulting in diminished production. As stated above, several patents are directed to solving this downthrust problem, for example, the Wilson (U.S. Pat. No. 4,741,668), and the Vandevier et al. (U.S. Pat. No. 4,678,399) patents. The Wilson patent discloses bearings, rather than the washers of the present invention. The term "bearing" generally refers to a two-component system, the components slidably engaged, typically having a layer of lubricant in between them. For instance, the bearings in Wilson ("thrust bearing assembly") are comprised of, in a very simple embodiment, a rotating thrust disc and a stationary bearing surface (plus carrier).

At least one inventor has attempted to deal with the radial stability and downthrust problems in a single invention. Bearden (U.S. Pat. No. 4,741,668) and James (U.S. Pat. No. 4,781,531) disclose such inventions. Alternatively, it may be preferable to treat the radial stability and downthrust problems separately, using different components, if, for instance, a system such as that disclosed in the Swatek patent were already being utilized to solve the radial compliance problem. The present invention is not directed to the radial stability problem, but the downthrust and related problems. Hence, the instant invention would be operable in concert with the invention disclosed in the Swatek patent, which is hereby incorporated by reference into the present application.

The earliest submersible centrifugal pumps were configured to receive the downthrust at each stage; they were known as floating-pump systems. These pumps were suitable for production systems where the hydraulic thrust generated by the stage was low. For high-production and deep wells, the thrust generated was too high for these systems to operate properly. Suitable materials could not be found from which to make the washers which bore the downthrust load in each stage.

In response to this, the full-compression pump was developed, the current state of the art device in the submersible centrifugal pump industry. In this system, the entire downthrust load is borne by a single protector thrust bearing (e.g., comprising a thrust pad and a thrust runner) located at the bottom of the protector. A protector prevents the produced fluid from contaminating the clean oil in the motor. A protector bearing is very large, much larger than load-bearing washers that receive the downthrust load from only a single stage. In addition, the protector bearing cannot be positioned in contact with the produced fluid. One major drawback to the full-compression system is that, since the impellers are in a fixed position (i.e., they are "stacked" hub to hub), they cannot "reseat" against a thrust pad or washer over time, therefore, "recirculation" occurs or is exacerbated. "Recirculation" refers to the retrograde movement of liquid in the impeller, not upward to the adjacent diffuser, but downward back into the impeller entry. This does not occur—or at least not for the same reason—in the floating-type pumps because the position of the impellers can "float" or move longitudinally along the shaft. Naturally, recirculation reduces overall hydraulic efficiency hence total production (the volume of fluid leaving the wellhead), and therefore is undesirable. A "recirculation path" is cut by the gradual erosion of portions of the impeller by abrasive particles contained in the fluid (e.g., sand). In pump designs where the impeller is not fixed to the shaft, the impeller can reposition against a washer as it is worn by abrasion, thus curtailing recirculation by cutting off or at least reducing the size of its path. But in a full-compression design, the impellers' positions are fixed (longitudinally) hence as a recirculation path is enlarged due to abrasion, the impeller cannot reposition against another portion of the pump to seal the gap. In addition, the full-compression pump design requires a more difficult installation procedure, and the high shaft loads associated with it also require more costly thrust bearings in the motor protector unit. The present invention is directed towards the shortcoming of both the floating-type pumps, and the full-compression pumps. It is an advance over the art from the point of view of full-compression pumps in that, since the downthrust is preferably, though not necessarily, handled by a load-bearing washer at each stage, the impellers can move longitudinally along the shaft. Inventions directed toward the downthrust load-bearing means positioned at each stage are Sheth (U.S. Pat. No. 4,838,758) and Bearden (U.S. Pat. No. 4,741,668). Yet neither invention exploits this movement by providing in one aspect of the invention a sealing washer, or a washer, whose essential function is to effect a seal between the diffuser and impeller, as the impeller shifts and then reseats against the diffuser due to inevitable movement caused by abrasion. Therefore, the present invention is comprised of two features, though not operatively engaged to one another in the pump device, nonetheless work together toward a single purpose—the load-bearing inner thrust washers of the present invention permit the impellers longitudinal movement along the shaft, which in turn allows the impeller to reseat against the diffuser, this reseating or repositioning takes place upon the sealing washer of the present invention, which reseals the gap between the diffuser and the impeller (exterior to the impeller eye) as the impeller shifts; the washers thus reduce recirculating fluid.

SUMMARY OF THE INVENTION

One object of the present invention is to provide a pump for pumping fluids comprising an inner thrust-bearing washer for bearing the downthrust load created by the reaction force of the fluid as it is discharged from the impeller and the pressure differential developed.

An other object of the present invention is to provide a pump for pumping fluids comprising an outer washer for creating a continuous seal between the impeller and diffuser as the impeller shifts during the life of the pump.

Thus in accordance with one aspect of the present invention, there is provided in a centrifugal pump having an exterior housing, a central shaft extending through the housing, and a plurality of stages, each stage comprised of an impeller having a plurality of vanes for moving produced fluid, and a stationary diffuser, an inner downthrust washer for receiving downthrust load produced by the stage in which it is located, and an outer sealing washer in each stage of the pump for preventing fluid recirculation.

In accordance with a preferred embodiment of the present invention, the inner downthrust washer referred to above does not control radial stability of said shaft.

In accordance with another preferred embodiment of the present invention, the inner downthrust washer referred to above is positioned between the upper shroud of said impeller and said diffuser thrust pad.

In accordance with yet another preferred embodiment of the present invention, the inner downthrust washer referred to above is positioned between said impeller and said diffuser, exterior to the shaft.

In accordance with still another preferred embodiment of the present invention, the outer sealing washer referred to above is positioned between the impeller and diffuser, exterior to the impeller eye.

In accordance with another embodiment of the present invention, the inner downthrust washer is made from a material selected from the group consisting of: tungsten carbide, PEEK-reinforced polymer, heat-treated steel, and coated tool steel.

In accordance with a particularly preferred embodiment of the present invention, the inner downthrust washer is made from tungsten carbide.

In accordance with still another embodiment of the present invention the outer sealing washer is made from a material selected from the group consisting of: teflon-based materials and polymeric materials.

In accordance with a particularly preferred embodiment of the present invention, the outer sealing washer is made from a teflon-based material.

In accordance with another preferred embodiment of the present invention, the inner downthrust washer is made from a different material than the outer sealing washer.

In accordance with another preferred embodiment of the present invention, the inner downthrust washer is made from a harder material than the outer sealing washer.

In accordance with still another preferred embodiment of the present invention, the pump is a submersible pump for operation in a subterranean well assembly.

In accordance with yet another preferred embodiment of the present invention, each stage contains an inner thrust washer, one per stage.

One advantage of the present invention is that, compared with a full-compression pump with a single downthrust load-bearing element, it achieves more effective sealing, which reduces recirculation.

A second advantage of the present invention is that, since it is directed only to downthrust, and not radial wear, systems used to treat radial stability can be left in place, and an embodiment of the present invention installed to address downthrust only.

A third advantage of the present invention is that since the thrust washer and radial bearing are different components, they do not have to be made from the same material, which it often preferable that they not be.

DETAILED DESCRIPTION OF THE PREFERRED EMBODIMENTS

The inner washer, or thrust washer, of the present invention is rotationally engaged to the shaft and bears the downthrust load. For a load-bearing washer, the "PV rating" is used to characterize the washer's ability to bear a downthrust load. It is equal to the load in psi multiplied by the velocity, in ft/sec. Preferably, the inner washer is made from a hard material with high strength and resistance to fracture. Additionally, it is desirable that it be abrasion resistant and corrosion resistant. Provided the thrust washer meet these general criteria, it can be made from a number of materials. One material that is particularly suited for use as a thrust washer is tungsten carbide. Some ceramic materials are suitable, though they are sufficiently hard, and have good compressive strength, they have poor flexure strength (i.e. brittle). Other suitable materials include: XC-2, which is a polyethylethyl ketone ("PEEK")-reinforced polymer; coated tool steel; and heat-treated steel.

In the present invention, the outer sealing washer in contrast to the inner thrust washer is not a load-bearing washer, but is designed to form a seal to reduce recirculation. Thus the outer washer is preferably made from a softer material than the outer sealing washer that is more formable or pliable which would allow the washer to continuously seal gaps created by abrasion of the impeller as abrasive particles contained in the fluid erode it. Additional attributes of the outer washer material are abrasion and corrosion resistance. One particularly suitable family of materials is teflon-based materials, especially RULON. Certain polymers may be suitable as well.

Figure 1:
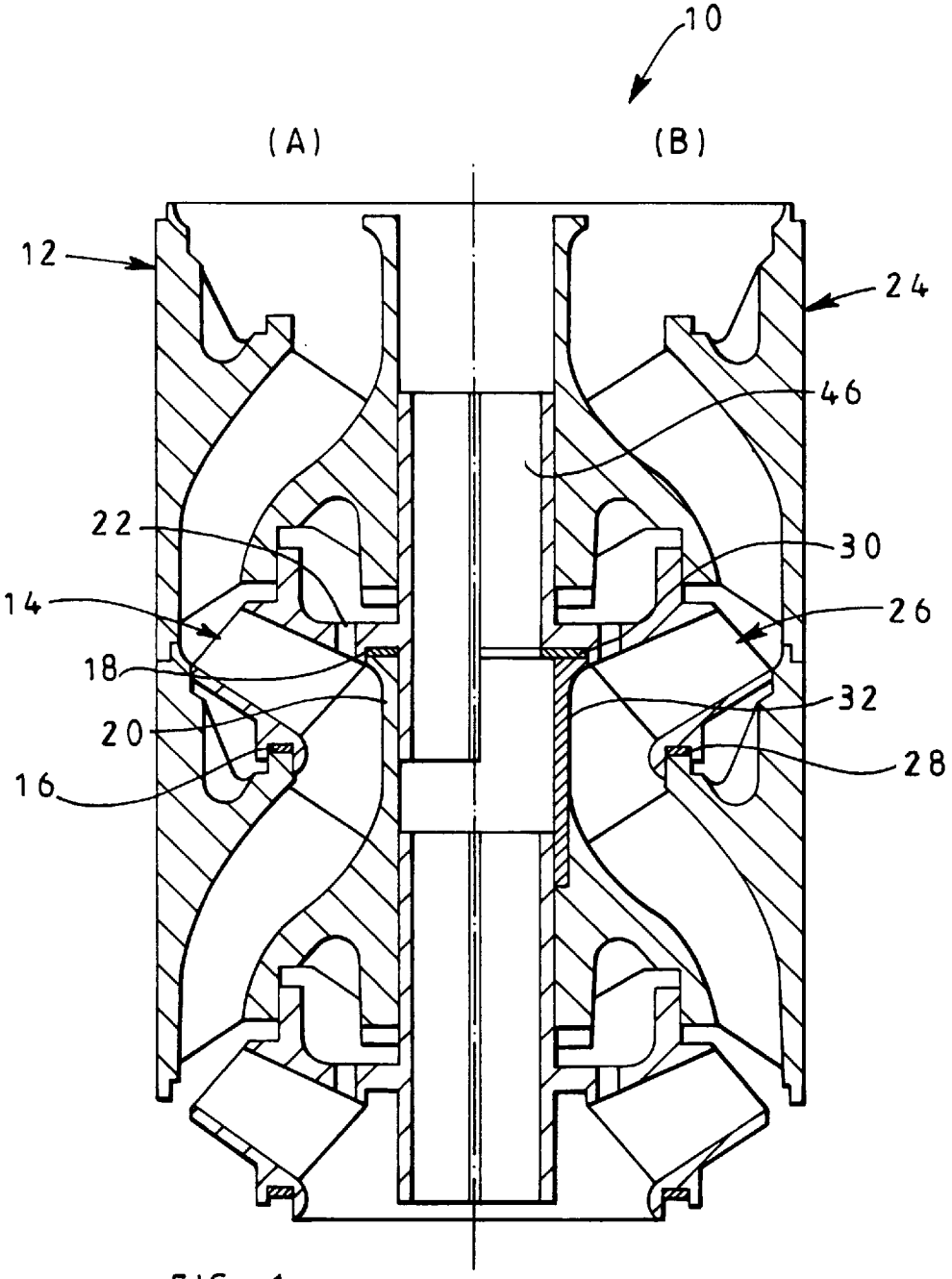
FIGS. 1 and 4 is a cross-sectional view showing a "composite" prior art fixed-impeller submersible centrifugal pump on the left (FIGS. 1A and 4A), and one embodiment of the present invention on the right (FIGS. 1B and 4B).
Figure 4:
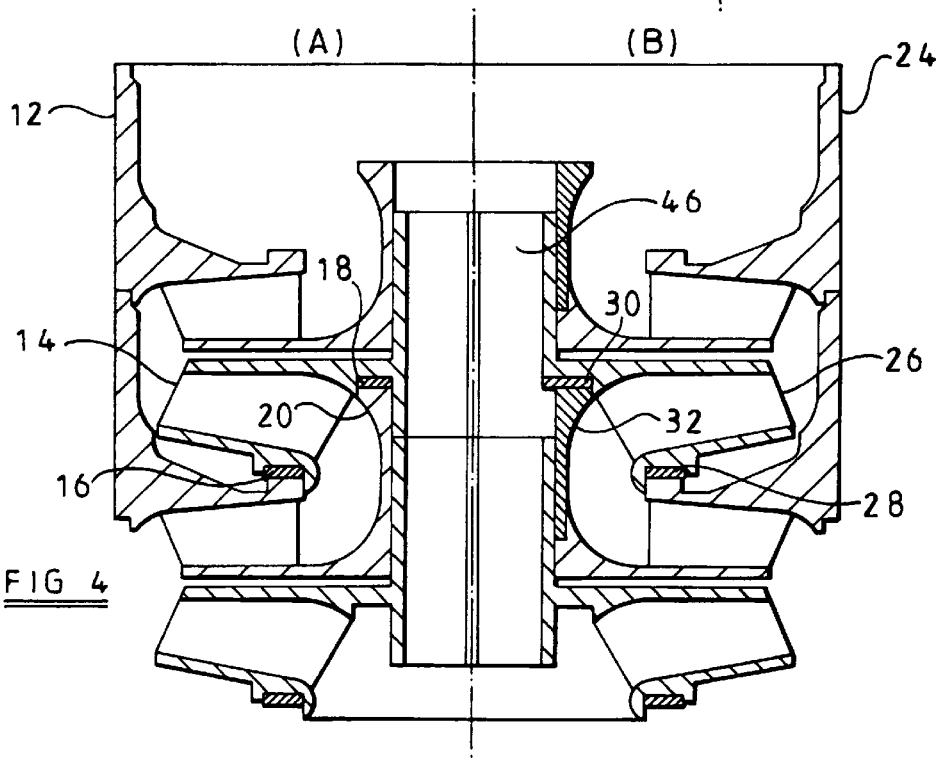

FIGS. 1 and 4 show the left half of a representative prior art submersible centrifugal pump on the left as FIGS. 1A and 4A, and the right half of one embodiment of the present invention on the right as FIGS. 1B and 4B. FIGS. 1A and 4A show a diffuser 12 and an impeller 14, both axially oriented, or oriented with respect to the direction of operation. The latter rotates to impart velocity to the fluid, the former is stationary. Many pumps in the prior art are compression style pumps which means that the impellers are positioned hub-to-hub so that any hydraulic thrust is carried through the hubs to the shaft and through the protector shaft to the protector thrust bearing (not shown). FIGS. 1A and 4A also show an outer sealing washer 16 and an inner sealing washer 18. These washers are used to prevent fluid recirculation caused ultimately by fluid pathways ("gaps") created by erosion of small portions of the impeller due to abrasive materials carried in the fluid. Because the stage (impeller plus diffuser) is longitudinally fixed (i.e., the impeller's position is set by the protector thrust bearing) these washers are highly susceptible to abrasive wear and washing away. When this occurs the gap continues to grow bigger because the impeller is unable to reposition against the washer, due to its fixed position. Next, FIGS. 1A and 4A show the diffuser pedestal 20. As shown in this particular embodiment of the prior art, it is not an insert but is actually a cast feature of the diffuser and is only used when an inner sealing washer is used. Finally, the balance hole 22 reduces downthrust by allowing low-pressure fluid to communicate with the cavity above the impeller.

FIGS. 1B and 4B show the essential features of the present invention. The stationary diffuser 24 transmits fluid velocity into dynamic head. The impeller 26 is driven by the central shaft 46 and thereby gives the fluid velocity and momentum. FIGS. 1B and 4B also show an outer sealing washer 28 and an inner thrust washer 30. In contrast to the prior art device shown in FIGS. 1A and 4A, rather than having two sealing washers, the present invention utilizes higher thrust stages to serve as floater pumps (not fixed to the shaft) by allowing the downthrust load to be borne by the inner thrust washer 30. Thus the outer washer 28 can be used solely for sealing—to prevent recirculation and a consequent loss of production. In other words, abrasive-containing fluid breakthrough is reduced because this stage acts as a floater, hence it has the ability to reseat, or reposition itself on the inner thrust washer and increase the possibility of sealing off any gaps created by abrasive particles through which fluid can pass. FIGS. 1B and 4B also show a diffuser thrust pad 32. This can be either the same hardness as the diffuser or harder. The diffuser thrust pad 32 provides a pad for the thrust washer to position against. It is a stationary piece which transmits any hydraulic thrust from the impeller into the diffuser without allowing the impeller and the diffuser touch, resulting in metal-to-metal rubbing contact. The diffuser thrust pad can be a cast feature or an insert. Also in contrast to the prior art device, the device embodying the present invention may not require a balance hole if the higher load thrust pads can carry the increased thrust which will prevent recirculation through the balancing area.

Figure 2:
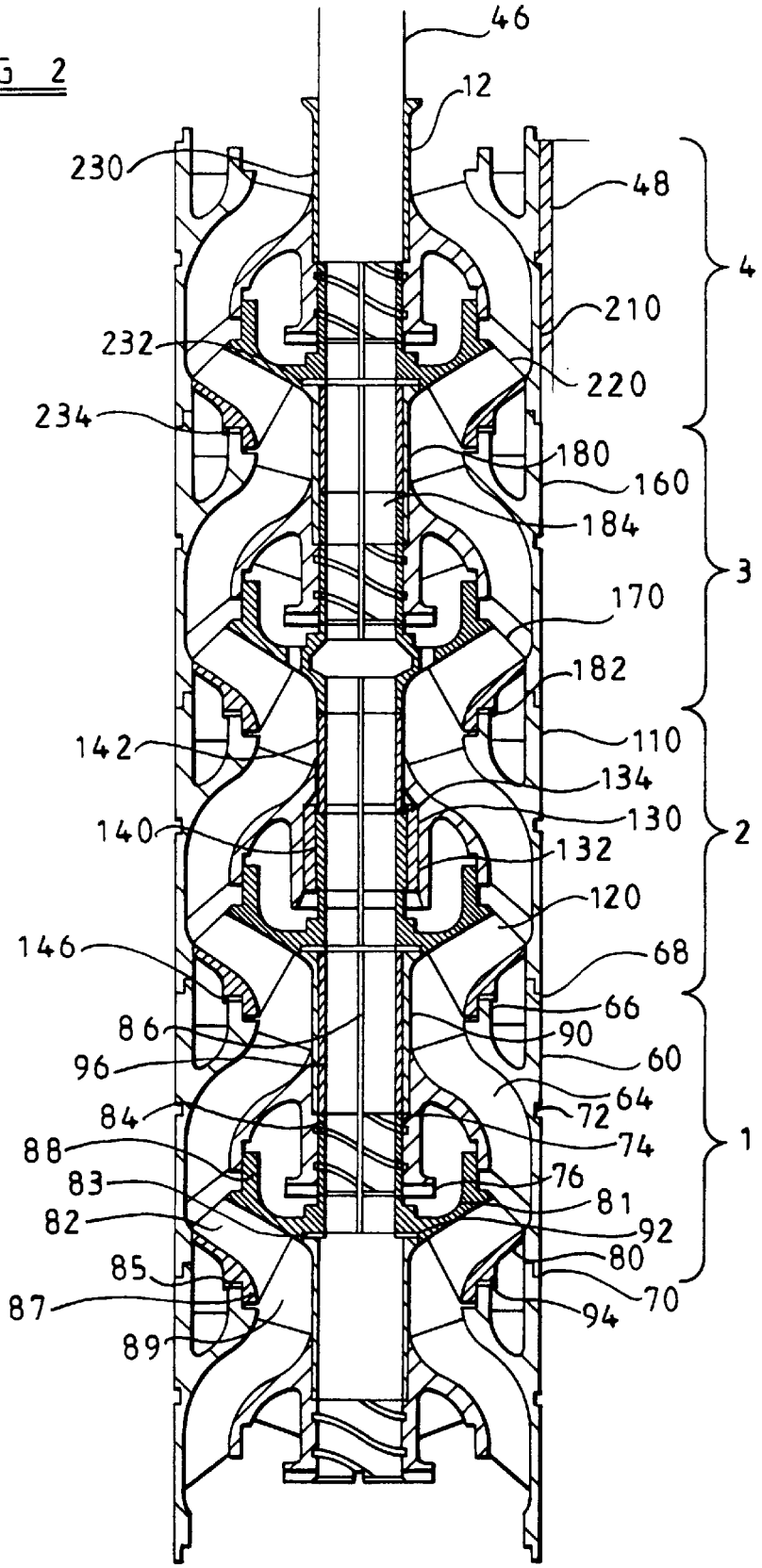
FIG. 2 is a cross-sectional view showing four stages of a submersible centrifugal pump having one embodiment of the present invention.

FIG. 2 shows the features of the present invention in more detail. FIG. 2 is a cross-sectional view showing four separate identical stages of a pump assembly. The four stages 1, 2, 3, and 4 are identical in that they are comprised of an impeller and a diffuser, yet different in some respects which will be explained in this description. The pump has a cylindrical housing 48. The shaft 46 extends concentrically through the housing 12. The shaft 46, rotates, driven by a motor (not shown), which in turn rotates the entire system since the impellers are keyed or fixed to the shaft. Fluid enters the first stage at the first impeller 80 via the impeller eye opening 89. The rotation of the impeller initiates fluid moving across the impeller vanes 82, thereby increasing the fluid velocity. The fluid moves upward and outward carried along the impeller vanes 82 until it discharges into the diffuser of the first stage 60, which is stationary and immediately adjacent to the impeller below it. Next, the fluid spirals upward and inward through the diffuser passages, as it moves from impeller to diffuser to impeller of the subsequent stage. The fluid travels upward and inward along the diffuser vanes until it reaches the impeller eye opening of the second stage. At the second stage, and indeed, in all subsequent stages thereafter, the fluid traces the same path as in stage one. Once the fluid reaches the second impeller 120 it again moves across the impeller vanes due the rotating motion of the impeller 120 about the central shaft 46. The fluid subsequently exits the impeller 120 into the second stage diffuser 110.

FIG. 2 also depicts additional features not described above because they are not crucial to a description of the movement of the fluid within the system. Again, the first stage of the system is shown as 50, three subsequent stages are also shown 100, 150, and 200. The purpose of the first stage diffuser 60 is to transform the fluid velocity of the fluid exiting the first impeller 80 into static head. The diffuser 60 is comprised of a plurality of diffuser vanes 64 whose purpose is to maintain the fluid direction as the fluid moves upward through the diffuser.

Figure 3:
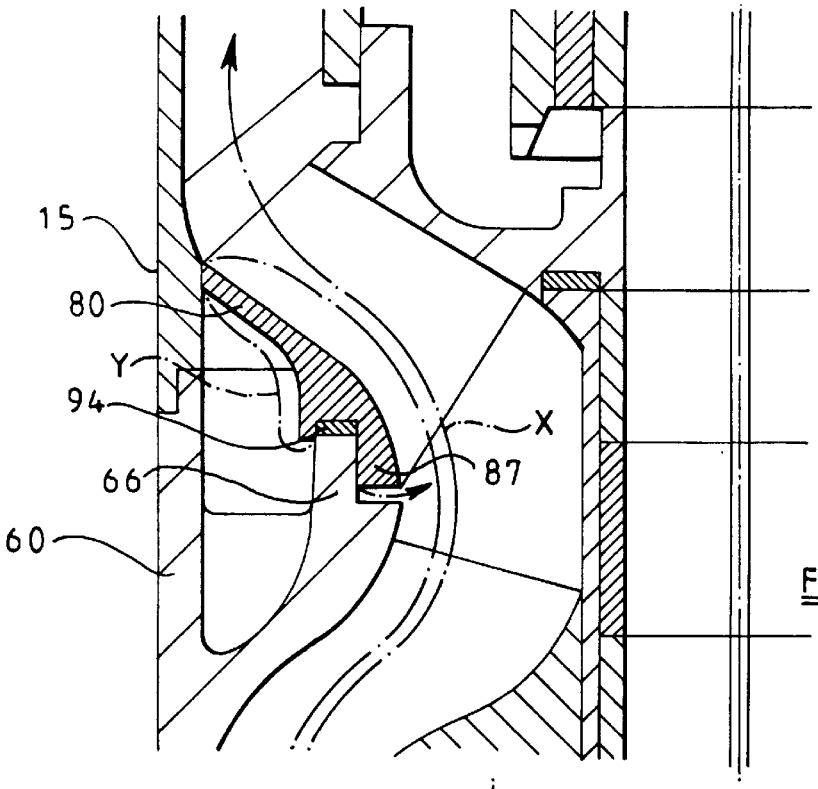
FIG. 3 is a cross-sectional enlarged view of FIG. 2, showing one alternate flow path created by abrasion.

The diffuser pad 66 serves as a surface upon which the impeller sealing washer (or outer sealing washer) 94 can seat against or upon—i.e., it is a stationary surface that washer can rotate against. One of the most persistent problems that results in lost production is recirculation. Recirculation refers to a fluid path other than the upward spiral path described above. More particularly, as oil is produced from the well and is pumped upward, it naturally contacts the various components of the pump system. Abrasive materials in the oil (e.g., sand) tend to abrade or erode the surfaces of the components, sometimes creating gaps between components, or exacerbating existing gaps. These gaps create alternate flow paths for the fluid, which result in less fluid tracking the flow path leading upward to the wellhead, thus ultimately resulting in lost production. The present invention is directed to eliminate or reduce recirculation. One common recirculation path is shown in FIG. 3. Again, the desired flowpath x is generally upward in a spiral flow path, moving from impeller to diffuser to impeller of the next stage. A recirculation pathway y can occur when the region between the inner wall of diffuser 15 which is normally fit with a close running clearance adjacent to the impeller 80, is impinged upon by fluid carrying abrasive particles until a gap is created. This pathway y is a favorable pathway for the fluid because it traces movement down a pressure gradient: from the high pressure side of the impeller to the low pressure side of the impeller. Abrasive particles carried by fluid moving through this gap can then erode the outer sealing washer 94 and the interior region formed by the juxtaposition of the impeller skirt 87 and the diffuser pad 66/diffuser 60. Hence, the sealing washer 94 allows the impeller 80 to reseat or reposition downward thereby effectively and continuously resealing the alternative flow path y.

FIG. 2 further depicts the additional features of the present invention. The upper diffuser nest 68 and lower diffuser nest 70 allow the diffusers of the various stages to stack together, one on top of the other. The upper diffuser nest 68 joins to the lower diffuser nest 70 of the stage above it. The sealing ring groove 72 holds an O-ring which is sealed to the housing 12. The diffuser bore 74 is the hole through the center of the diffuser surrounding the impeller hubs and shaft. The diffuser cooling grooves 76 permit cooling liquids to enter the shaft area to prevent overheating caused by friction.

The first stage impeller 80 rotates thereby giving the fluid velocity that will later be turned into head as it rises to the adjacent diffuser 60. The impeller vanes 82, positioned in the interior of the impeller 80, and encases within the upper impeller shroud 81, move the fluid in an upward and outward direction. The impeller hub 84 is a component of the impeller 80 which is keyed (fixed) to the shaft 46 and allows the impeller 80 to rotate with the shaft 46 when driven by an electric motor (not shown). The inner downthrust washer 92, which is one key feature of the present invention, is located atop the diffuser thrust pad 90, and is preferably a hardened pad that receives the hydraulic thrust load from the impeller. The diffuser thrust pad 90 can be either an insert or a cast feature. The outer washer pad 85 acts as a surface for the diffuser 60 so that the outer sealing washer 94 will have a surface to seat against. The impeller skirt 87 is the covering for the impeller eye opening 89. The balance ring provides a region to balance the impeller 80 to prevent vibration. It also forms a low-pressure chamber above the impeller to reduce downthrust in designs requiring a balance hole. The impeller eye opening 89 is the entrance for the fluid into the impeller 80 immediately after it leaves the diffuser 60 in the stage below. The fluid moves from the eye 89 to the impeller vanes 82. The diffuser thrust pad insert 90 provides a surface for the inner thrust washer 92 to position against, hence the diffuser thrust pad insert 90 transmits stage thrust from the impeller 80 to the diffuser 60 and eventually to the housing 48.

Next, the inner downthrust washer 92, a key feature of the present invention, permits the transfer of thrust from the impeller 80 to the diffuser 60 such that the two are not in metal-to-metal contact. Downthrust washers are shown in stages 1, 2, 4, one downthrust washer per stage. A downthrust washer is not shown in stage 3. In one particularly preferred embodiment of the present invention, the pump is comprised of one downthrust washer per stage, since this allows optimal reseating of the impellers against the diffuser pads, though the invention is not limited to this particular configuration. In other embodiments of the present invention, a single downthrust washer may bear the downthrust load from that stage in which it is located, and a plurality of stages above that stage.

The outer sealing washer 94, another key feature of the present invention, is preferably made from a softer, pliable material so that it can permit the impeller 80 to reposition against diffuser 60. The shaft spacer 96 occupies excess space immediately adjacent to the shaft 46 to prevent any foreign material from getting between the shaft 46 and the impeller 80.

Whereas this invention is illustrated and described in detail with particular reference to presently preferred embodiments of this invention, it should be understood that innumerable changes are possible without departing from the inventive concepts claimed.

What is claimed is:

1. A multi-stage submersible centrifugal pump, comprising:

a housing having an inlet and an outlet;

a shaft extending generally longitudinally within the housing and through a plurality of pump stages, each of said stages having an axially oriented diffuser disposed generally about a longitudinal axis of said shaft;

an axially oriented impeller disposed adjacent said diffuser and rotatably engaged about said shaft;

an inner downthrust washer rotationally engaged to said shaft or said impeller, said thrust washer being adapted for receiving downthrust loads from said impeller;

an outer sealing washer rotationally engaged to said impeller for preventing fluid recirculation in said stage; and a stationary thrust pad distinct from said thrust washer, said thrust pad being mounted about said shaft and positioned between said downthrust washer and said diffuser, such that said thrust pad and said downthrust washer are adapted to provide transmission of hydraulic thrust from said impeller to said diffuser without contact between said impeller and said diffuser.

2. The pump of claim 1 wherein said inner downthrust washer does not control radial stability of said shaft.

3. The pump of claim 1, wherein said inner downthrust washer is positioned between said upper shroud of said impeller and said thrust pad.

4. The pump of claim 1, wherein said inner downthrust washer is positioned between said impeller and said diffuser, and exterior to said shaft.

5. The pump of claim 1, wherein said outer sealing washer is positioned between said impeller and said diffuser, and exterior to an eye of said impeller.

6. The pump of claim 1, wherein said inner downthrust washer is made from a material selected from the group consisting of: tungsten carbide, PEEK-reinforced polymer, heat-treated steel, and coated tool steel.

7. The pump of claim 1, wherein said inner downthrust washer is made from tungsten carbide.

8. The pump of claim 1, wherein said outer sealing washer is made from a material selected from the group consisting of: teflon-based materials, and polymeric materials.

9. The pump of claim 1, wherein said outer sealing washer is made from a teflon-based material.

10. The pump of claim 1, wherein said inner downthrust washer is made from a material different from said outer sealing washer.

11. The pump of claim 1, wherein said inner downthrust washer is made from a material harder than said outer sealing washer.

12. The pump of claim 1, wherein said pump is a submersible pump for operation in a subterranean well assembly.

13. The pump of claim 1, wherein said inner downthrust washer receives said downthrust load produced by the stage in which it is located.

14. A submersible centrifugal pump, comprising:

a housing having an inlet and an outlet;

a shaft extending generally longitudinally within the housing;

an axially oriented diffuser disposed generally about a longitudinal axis of said shaft;

an axially oriented impeller disposed adjacent said diffuser and rotatably engaged about said shaft;

an inner downthrust washer rotationally engaged to said shaft or said impeller, said thrust washer being adapted for receiving downthrust load from said impeller; and a stationary thrust pad distinct from said thrust washer, said thrust pad being mounted about said shaft and positioned between said downthrust washer and said diffuser, such that said thrust pad and said downthrust washer are adapted to provide transmission of hydraulic thrust from said impeller to said diffuser without contact between said impeller and said diffuser.

15. The pump of claim 14, further comprising an outer sealing washer rotationally engaged to said impeller for preventing fluid recirculation.

16. The pump of claim 14, wherein said inner downthrust washer is positioned between an upper shroud of said impeller and said thrust pad.

17. The pump of claim 14, wherein said inner downthrust washer is positioned between said impeller and said diffuser, and exterior to said shaft.

18. The pump of claim 14, wherein said inner downthrust washer is made from a material selected from the group consisting of: tungsten carbide, PEEK-reinforced polymer, heat-treated steel, and coated tool steel.

* * * * *